US007090513B2

(12) United States Patent
Kuo

(10) Patent No.: US 7,090,513 B2
(45) Date of Patent: Aug. 15, 2006

(54) ELECTRICAL CARD CONNECTOR

(75) Inventor: Ming-Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/028,051

(22) Filed: Dec. 31, 2004

(65) Prior Publication Data

US 2005/0277333 A1 Dec. 15, 2005

(30) Foreign Application Priority Data

Jun. 11, 2004 (TW) ..... 93116822 A

(51) Int. Cl.
*H01R 13/648* (2006.01)

(52) U.S. Cl. ..... 439/92; 439/947

(58) Field of Classification Search ..... 439/92, 439/108, 159, 160, 630, 631, 947, 946, 607
See application file for complete search history.

(56) References Cited

U.S. PATENT DOCUMENTS

| | | | | |
|---|---|---|---|---|
| 6,080,017 | A * | 6/2000 | Yu et al. | 439/607 |
| 6,352,438 | B1 * | 3/2002 | Wu | 439/92 |
| 6,361,338 | B1 * | 3/2002 | Chang | 439/159 |
| 6,468,094 | B1 * | 10/2002 | Kuo | 439/108 |
| 6,626,689 | B1 * | 9/2003 | Yu | 439/159 |
| 6,773,275 | B1 * | 8/2004 | Chen | 439/92 |
| 2005/0106944 | A1 * | 5/2005 | Kuo | 439/630 |
| 2005/0227520 | A1 * | 10/2005 | Wu | 439/159 |
| 2005/0272283 | A1 * | 12/2005 | Chang | 439/92 |
| 2005/0272291 | A1 * | 12/2005 | Chang | 439/159 |
| 2005/0287855 | A1 * | 12/2005 | Taguchi | 439/159 |
| 2005/0287870 | A1 * | 12/2005 | Kuo | 439/630 |
| 2006/0040561 | A1 * | 2/2006 | Chang et al. | 439/630 |

FOREIGN PATENT DOCUMENTS

| | | |
|---|---|---|
| TW | 487881 | 5/2002 |
| TW | 555270 | 9/2003 |
| TW | M246779 | 10/2004 |
| TW | M 250345 | 11/2004 |

* cited by examiner

*Primary Examiner*—Ross Gushi
(74) *Attorney, Agent, or Firm*—Wei Te Chung

(57) ABSTRACT

An electrical card connector (1) is provided for accommodating an electrical card. The electrical card connector comprises a dielectric housing having a plurality of connector terminals (20), a pair of soldering pieces (30), a shielding (40) assembled on the dielectric housing and defining an insertion port for insertion therein of the electrical card, and an ejector (70) for ejecting the electrical card received in the card connector. The soldering pieces are received respectively in slots of the dielectric housing and have legs for engaging with grounding pads of a printed circuit board. The shielding is formed with tabs (433, 443) extending to abut against the soldering pieces in the slots for establishing grounding pathes between the shielding and the printed circuit board.

10 Claims, 5 Drawing Sheets

ELECTRICAL CARD CONNECTOR

BACKGROUND OF THE INVENTION

1. Field of the Invention

The present invention is generally related to an electrical card connector, and more particularly, to an electrical card connector having an improved shield device.

2. Description of Related Art

Most notebooks are provided with PC card connectors for accommodating PC cards as storage mediums. For adapting to the developments of the communication technology and electronical technology, the industry standard of the PC card need to update ceaselessly, according to the newest industry standard (Expresscard PC Card Standard), a PC card has a much quicker speed than conventional PC cards at data transmission, but thus enhancing the influence of the EMI and adversely affecting electrically performance of the electrical card connector.

In order to achieve a better electrical performance, a conventional electrical card connector is equipped with grounding devices to electrical connect with ground traces of a printed circuit board on which the connectors is mounted. Usually, such grounding devices may be a part extending from a shielding formed and stamped from a metallic plate or a pair of stand off devices assembling on sides of the shielding. However, since the extending part from the shielding usually is a thin metallic lath, it is easily to distort even break the extending part before the electrical card connector mounts on the printed circuit board, and the stand off devices for providing clearance between the connector and the printed circuit board are often far from the transfer interface, so it will influence the effect of anti-EMI.

U.S. Pat. No. 6,626,689 discloses an improved electrical card connector including an elongated dielectric housing having a plurality of connector terminals, a shielding covering the dielectric housing and a pair of stand off devices attaching to opposite sides of the shielding. A pair of screw holes are defined on opposite ends of the upper surface of the dielectric housing, a pair of bolts insert respectively into the screw holes to mount the electrical card connector on a printed circuit board, simultaneity, a tail portion of each bolts connects with a ground traces of the printed circuit board and the shielding abuts against the bolts at a edge thereof to establish a grounding path by the blots. However, these additional bolts will increase the difficulties of the assembly and the costs of the electrical card connector.

Hence, an electrical card connector is required to overcome the disadvantages of the related art.

SUMMARY OF THE INVENTION

Accordingly, an object of the present invention is to provide an electrical card connector having a pair of soldering pieces to solder with grounding pads on a printed circuit board, and a shielding electrical connecting with the soldering pieces to reduce EMI effect.

Another object of the present invention is to provide an electrical card connector which can retain a dielectric housing on a printed circuit board reliably.

To achieve the above objects, an electrical card connector in accordance with the present invention comprises a dielectric housing having a plurality of connector terminals and defining a pair of slots on opposite ends thereof, a pair of soldering pieces, a shielding assembling on the dielectric housing and defining an insertion port for insertion therein of an electrical card, and an ejector for ejecting the electrical card received in the card connector. Each soldering pieces is formed with a perpendicular wall received respectively in a slot of the dielectric housing and a leg extending from the base to fix on a grounding pad of a printed circuit board. The shielding is formed with tabs extending from sidewalls thereof to abut against the corresponding base of the soldering pieces received in the slots to establish a grounding path between the shielding and the printed circuit board.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
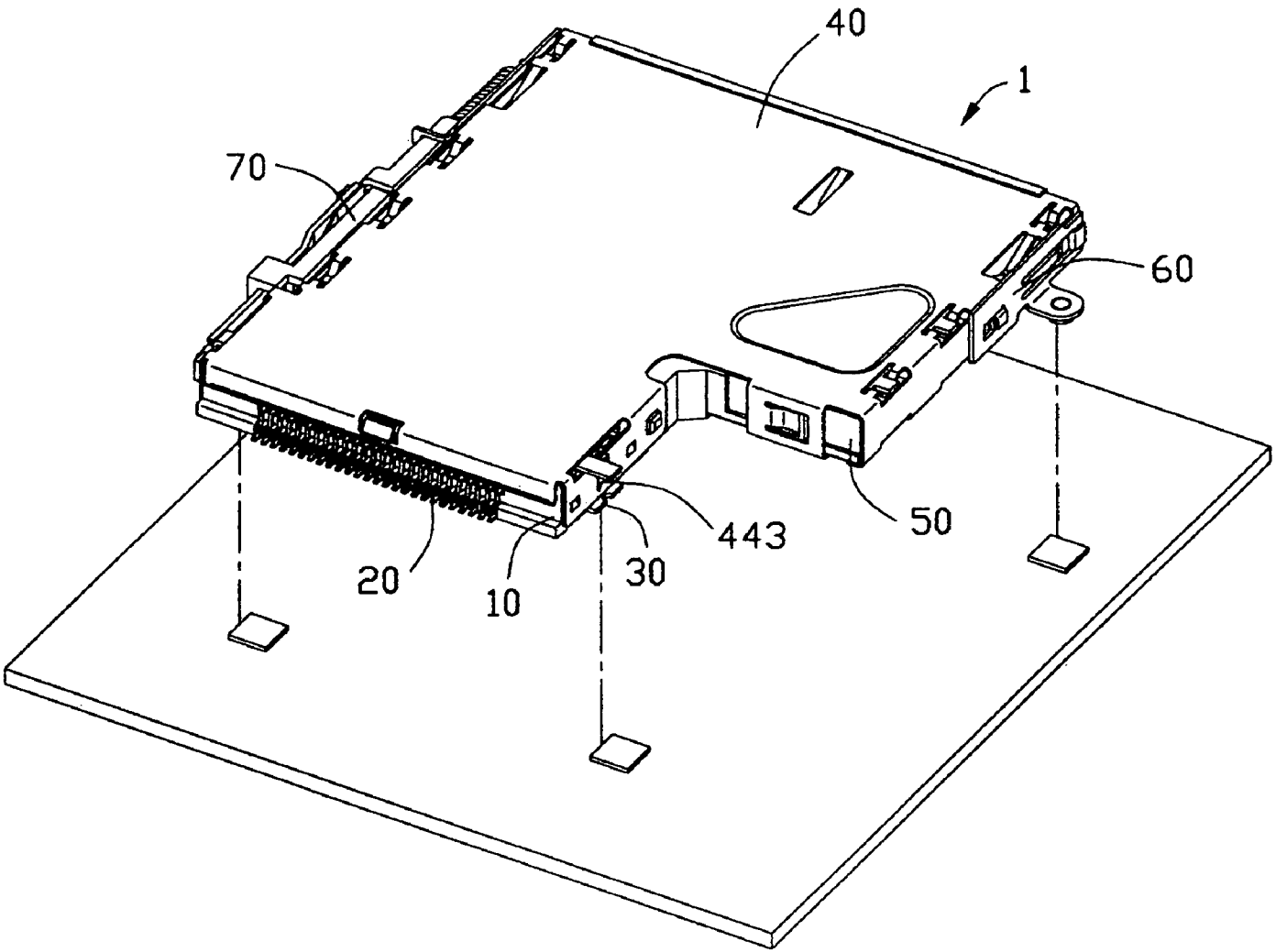
FIG. 1 is a perspective view of an electrical card connector in accordance with the present invention and a printed circuit board to which the electrical card connector is to be mounted.
Figure 2:
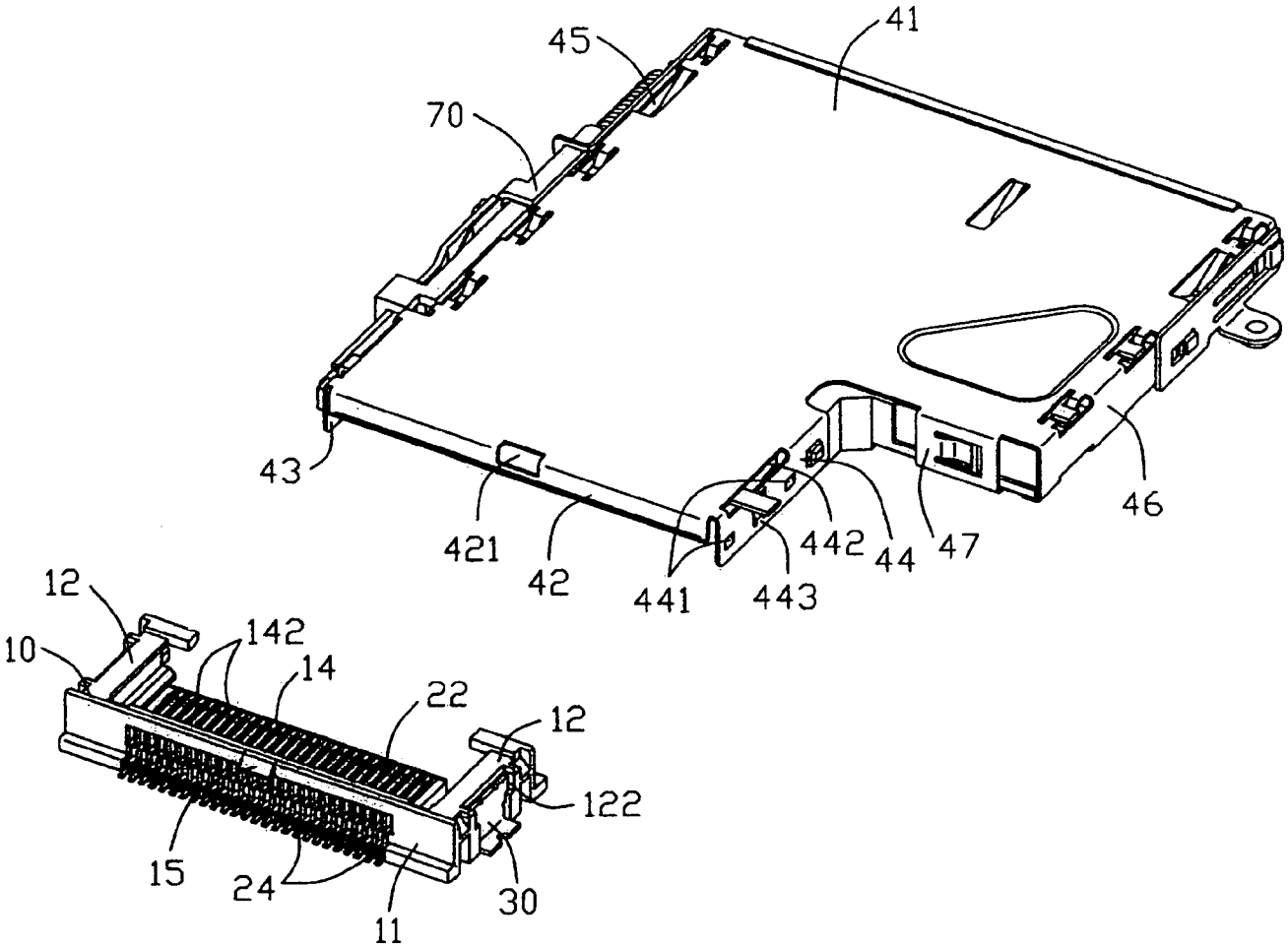
FIG. 2 is a perspective view of the electrical card connector shown in FIG. 1, wherein the shielding is not assembled.

Referring to FIG. 1 and FIG. 2, an electrical card connector 1 in accordance with the present invention comprises an elongated dielectric housing 10 having a plurality of connector terminals 20, a pair of soldering pieces 30 received in the dielectric housing 10, a shielding 40, a guide element 50, a pair of stand off devices 60 and an ejector 70.

Figure 3:
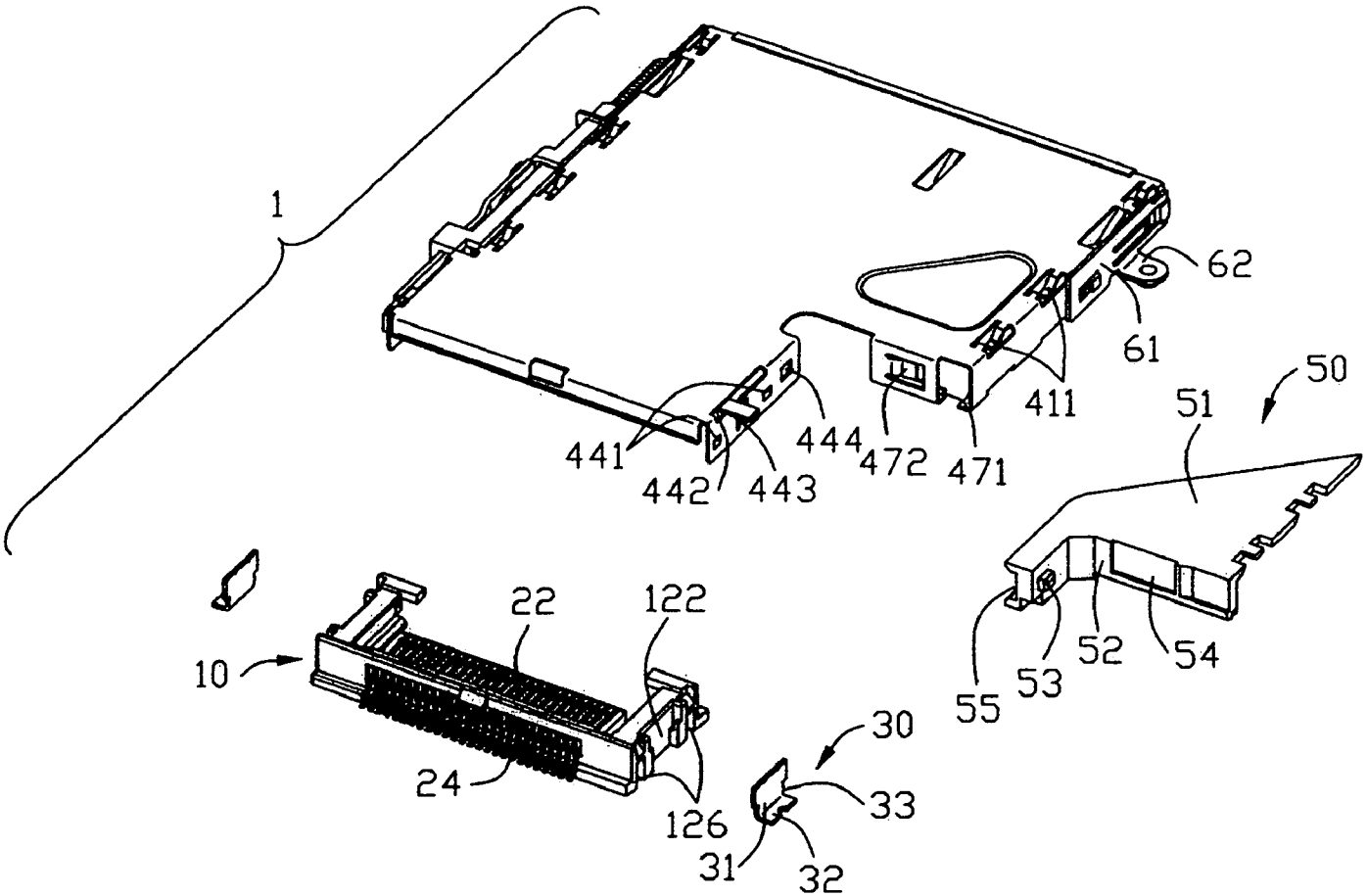
FIG. 3 is an exploded, perspective view of the card electrical connector shown in FIG. 2.

Referring to FIG. 2 and FIG. 3, the elongated dielectric housing 10 has a base 11, a pair of guide racks 12 extending backwardly from opposite ends of the base 11 and a mating portion 14 extending from a central section of the base 11 and disposed between the two guide racks 12. The base 11 is formed with a block 15 at the front sidewall thereof for engaging with the shielding 40. Each guide rack 12 defines a slot 122 extending downwardly from the upper surface thereof and opening in a side face thereof. Each guide rack 12 further defines a plurality of latch holes 126 besides the slot 122. The mating portion 14 is formed with a plurality of parallel channels 142 for receiving the connector terminals 20. Each connector terminals 20 has a contact portion 22 for electrical connecting with an electrical card, a tail 24 for electrically connecting with a printed circuit board and a fixing portion (not shown) disposed between the contact portion 22 and the tail 24 and fixed in the channels 142 of the dielectric housing 10.

The soldering pieces 30 are inserted into the slots 122 of the guide rack 12, respectively, and each of the soldering pieces 30 has a vertical wall 31 retained in the slot 122 with a plurality of stabs 33 formed on the side edge thereof interferentially engaging with an inner surface of the slot 122 and a leg 32 extending from the vertical wall 31 and protruding out of the dielectric housing 10 to fixing on a grounding pad of the printed circuit board. Since the slot 122 opens in the side face of the guide rack 12, a part of the vertical wall 31 is exposed.

Referring to FIGS. 2–5, the shielding 40 is formed and stamped a metallic sheet. The shielding has a main body 41 in a "L" type shape and a plurality of sidewalls extending downwardly from edges of the main body 41 to form a receptacle space for accommodating the electrical card cooperating with the main body 41. These sidewalls comprise a front wall 42 extending from a front edge of the main body 41, a first and a second sidewalls 43, 44 at opposite sides of the front wall 42, a third sidewall 45 disposed in the same side with the first sidewall 43, a fourth sidewall 46 disposed in the same side with the second sidewall 44 and a longitudinal sidewall 47. The first and the second sidewalls 43,44 are respectively adjacent to opposite ends of the front wall 42, the third and the fourth sidewalls 45,46 are respectively parallel to the first and the second sidewalls 43, 44, and the longitudinal sidewall 47 is disposed between the second sidewalls 44 and the fourth sidewall 46.

When the shielding 40 is assembled on the dielectric housing 10, the main body 41 covers an upper surface of the dielectric housing 10, the front sidewall 42 shields the front face of the dielectric housing 10 and defines a gap 421 to engage with the block 15 of the dielectric housing 10, and the first and the second sidewalls 43,44 respectively cover the side face of the guide rack 12. The first sidewall 43 is formed with a plurality of latches 431 extending into corresponding latch holes 126 to fix the shielding 40 to the dielectric housing 10. The first sidewall 43 defines a cut 432 for the ejecting rod 75 of the ejector 70 passing there through. Further more the first sidewall 43 is formed with an elastic piece 433 extending inwardly to electrically abut against the corresponding soldering piece 30 received in the slot 122. The second sidewall 44 has a same configuration with the first sidewall 43, and has a plurality of latches 441, a cut 442 and an elastic piece 443 abutting against the corresponding soldering piece 30.

Horizontal plates 451,461 extends inwardly from hemlines of the third and the fourth sidewall 45,46, respectively. Guide grooves 452,453 are defined between the horizontal plates 451,461 and the main body 41 for guiding and holding the insertion/ejection of the electrical car. The horizontal plates 451,461 are formed with a plurality of extrusive slices 453,463 along the inserting direction of the electrical card, and the main body 41 is formed with a plurality of depressed slices 411 above the corresponding slices 453,463. The electrical card will not swash in an up and down direction in the receptacle space of the shielding 40 due to being resiliently sandwiched by these oppositely disposed slices 411,453,463. The longitudinal sidewall 47 is bended backwardly from a hemline thereof to form a receive portion 471 for the guide element 50 with a spring arm 472 extending to the receive portion 471.

Figure 4:
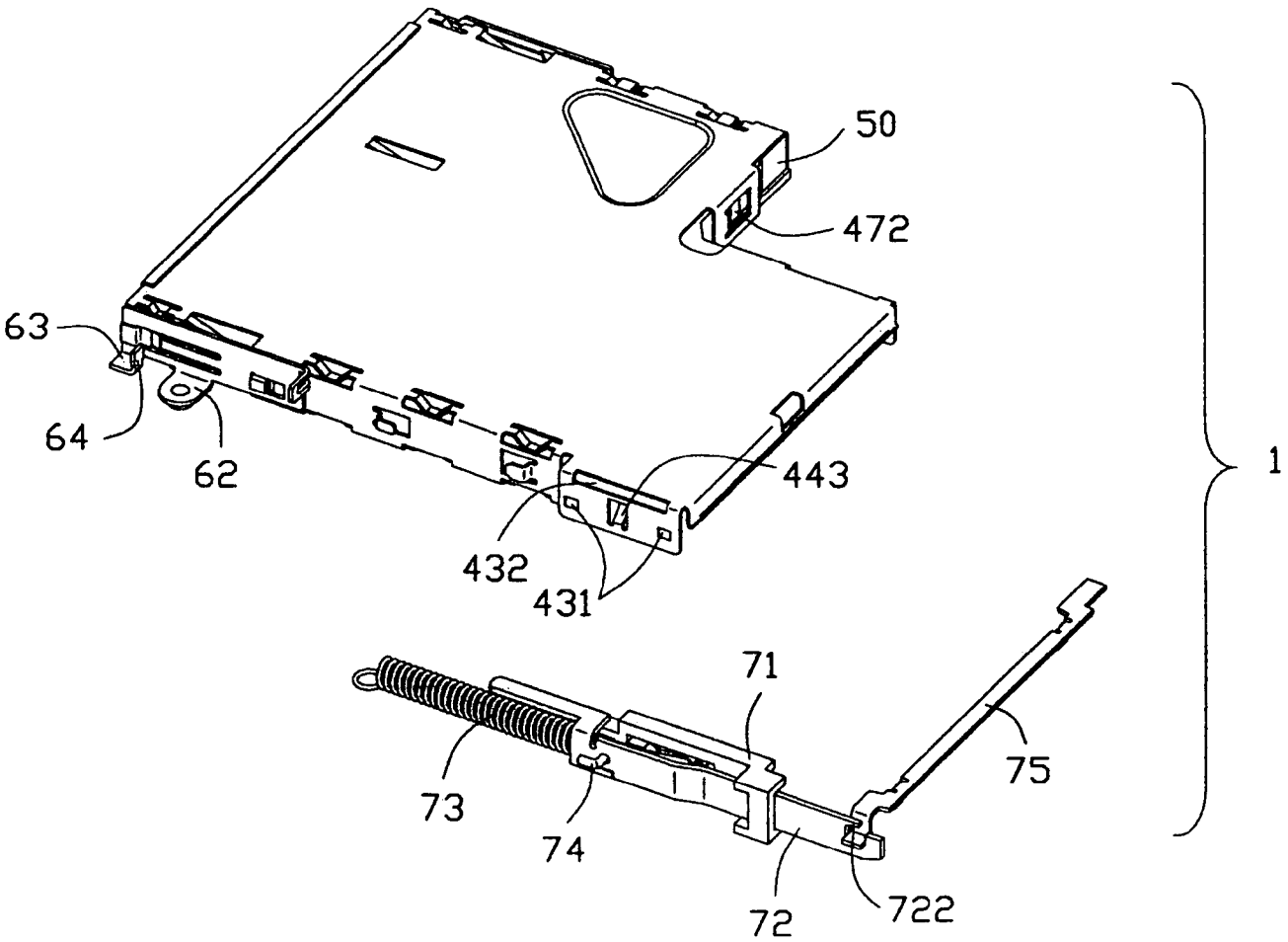
FIG. 4 is an exploded, perspective view of the shielding and an ejector of the card electrical connector shown in FIG. 2, taken from another angle.

Referring to FIGS. 2–4, the guider element 50 is approximately in a triangle shape, and has a board 51 and a "L" shape perpendicular wall 52 extending forwards and downwardly from the front of the board 51. The board 51 is received in the receive portion 471 of the longitudinal sidewall 47 and abuts against the fourth sidewall 46, the perpendicular wall 52 abuts against the second sidewall 44 of the shielding plate 40. The perpendicular wall 52 is formed with a projection 53 and a depressed portion 54 on an out surface thereof, the spring arm 472 of the longitudinal sidewall 47 is abutting against an inner sidewall of the depressed portion 54, and the second sidewall 44 of the shielding plate 40 is formed with a fixing hole 444 engaging with the projection 53 of the guider element 50. The perpendicular wall 52 is defined a guide channel 55 extending from the front portion of the perpendicular wall 52 for guiding the electrical card inserting into or ejecting out of the electrical card connector 1.

Each of the stand off device 60 has a flake 61 assembling on the shielding 40 and an engaging portion 62 soldered to a grounding pad of the printed board circuit. Further more the stand off device 60 in the same side with the ejector 70 is provided with an extrusive plate 63 with a tab 64 extending upwardly (referring to FIG. 4).

Figure 5:
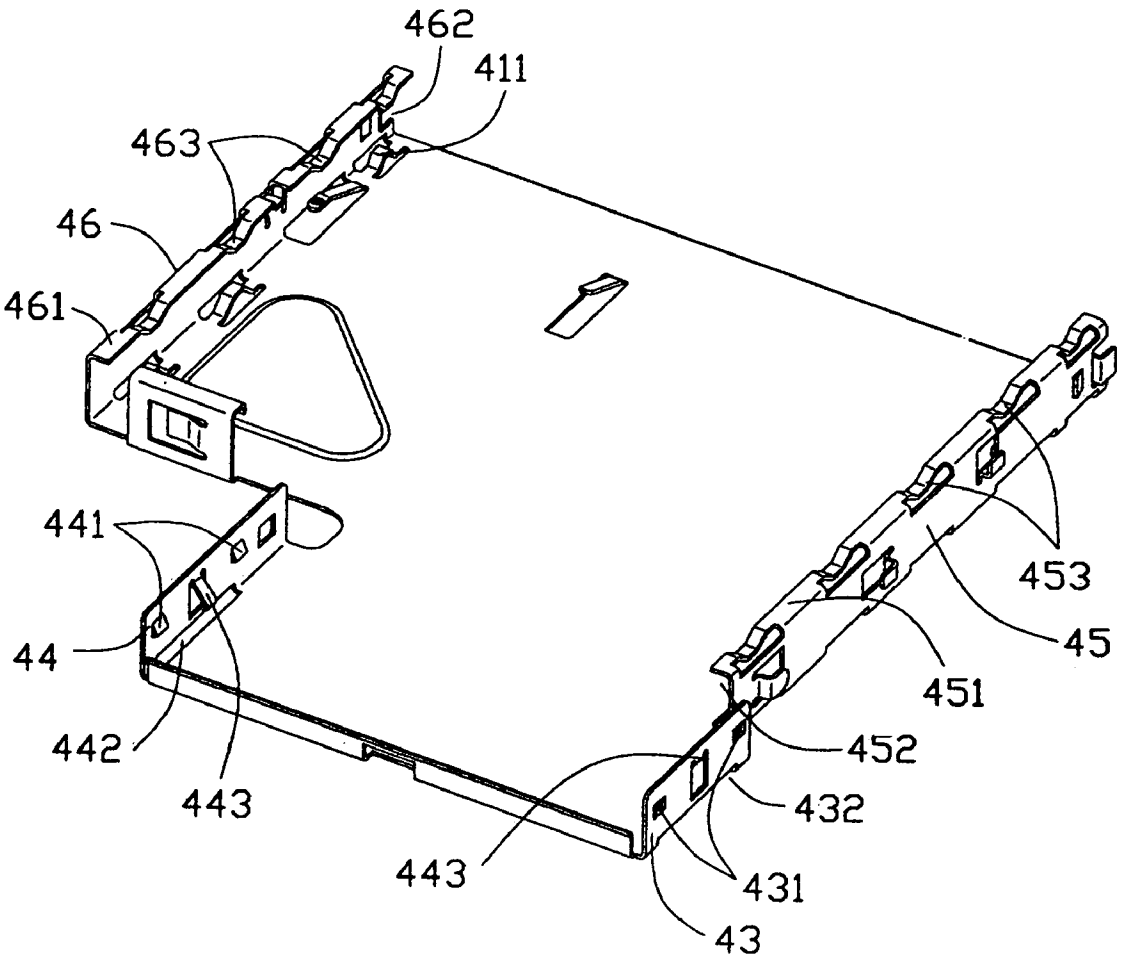
FIG. 5 is an bottom, perspective view of the shielding of the card electrical connector shown in FIG. 1.

Referring to FIG. 4 and FIG. 5, the ejector 70 is attached to the third sidewall 45 of the shielding plate 40 and comprises a slider 71 having a heart groove, a push rod 72, a spring 73, a link pin 74 and an ejecting rod 75. The push rod 72 is slidely assembled on the slider 71 with a limit hole 722 defined at an end thereof. The spring 73 has a two ends, one end is fasten to the tab 64 of the stand off 60 assembled on the shielding 40, and the other clasps to the push rod 72 to drive the push rod 72 to slider toward an original position of the push rod 72. The link pin 74 connects with the push rod 72 and may slider in the heart groove of the slider 71. The ejecting rod 75 is sandwiched in between the dielectric housing 10 and the shielding 40 by passing through the cuts 432, 442 of the shielding 40 and rotataly connecting with the push rod 72 via the limit hole 722.

The ejector 70 is a push-push type, during inserting the electrical card into the electrical card connector 100, a front face of the electrical card push the ejecting rod 75 to rotate, so that the push rod 72 is brought to move rearward along with the ejecting rod 75 and the link pin 74 slides in the heart groove. In this state, the spring 73 is deformed until the link pin 74 into a lock position of the heart groove, whereby the electrical card is fully inserted into the electrical card connector 1 and electrical connects with the contactor terminal 20. Pushing the electrical card forward again, the link pin 74 is released from the lock position, then the push rod 72 move forward driven by the resilience force of the spring 73 to bring the ejecting rod 75 to eject the electrical card out of the electrical card connector 1.

When the assembled electrical card connector 1 is mounting on the printed circuit board, the pair of soldering pieces 30 are soldered to the grounding pad on the printed circuit board to mount the dielectric housing 10 on the printed circuit board. Since the elastic pieces 433,443 of the shielding 40 abut against corresponding soldering pieces 30, so the grounding path of the shielding 40 is established by the soldering piece 30 and is closed to transfers interface to make the electrical card connector 1 get a good anti-EMI effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

a dielectric housing having a mating portion for mating with an electrical card;

a plurality of connector terminals respectively received in the dielectric housing, each connector terminal having a connecting portion for connecting with the electrical card, a tail for engaging with a printed circuit board and a fixing portion between the connecting portion and the tail;

a pair of solder pieces assembled on the dielectric housing, each solder piece having a vertical wall retained in the dielectric housing and a leg extending from the vertical wall for being mounted to the printed circuit board; and a shielding covering the dielectric housing, the shielding having a main body and a plurality of sidewalls extending downwardly from edges of the main body to form a receptacle space for accommodating the electrical card and a pair of guide grooves for guiding and holding an insertion/ejection of the electrical card cooperating with the main body, the shielding electrically connecting with the solder pieces.

2. The electrical card connector as claimed in claim 1, wherein a pair of slots are defined in opposite ends of the dielectric housing, the perpendicular walls of the solder pieces are received in corresponding slots.

3. The electrical card connector as claimed in claim 2, wherein a part of each slot communicates with the outside space, so the vertical walls are exposed sidewardly.

4. The electrical card connector as claimed in claim 3, wherein the shielding is formed with elastic pieces extending toward corresponding slots and abutting against the solder pieces in the slots.

5. The electrical card connector as claimed in claim 1, further comprising a pair of stand off devices fixed respectively to the sides of the shielding, each stand off device has a flake assembling on a corresponding sidewall and an engaging portion soldered to a grounding pad of the printed board circuit.

6. The electrical card connector as claimed in claim 1, wherein the dielectric housing defines a plurality of latch holes on the side surfaces, and the shielding is formed with a plurality of latches engaging with corresponding latch boles of the dielectric housing.

7. The electrical card connector as claimed in claim 1, wherein the dielectric housing is formed with a block on a front face thereof and wherein a front wall of the shielding covering the front face of the dielectric housing defines a gap for receiving the block.

8. The electrical card connector as claimed in claim 1, wherein the main body of the shielding is in an "L" type shape, these sidewalls comprise a first and a second sidewalls extending from opposite sides of the front of the shielding, a transverse wall disposed parallel to and in a same side with the second sidewall and a longitudinal wall disposed between the second sidewalls and the transverse wall.

9. The electrical card connector as claimed in claim 8, further comprising a guide, the guide has a board assembled between the longitudinal wall and the transverse wall of the shielding and a "L" shape guide portion extending forwards and downwardly from the front of the board to abut against the second sidewall of the shielding.

10. The electrical card connector as claimed in claim 8, further comprising an ejector attached to a side of the shielding, the ejector has a slider formed with a heart groove, a push rod slidely assembled on the slider, a spring, a link pin and an ejecting rod, the link pin connects with the push rod and moves in the heart groove according to the movement of the push rod, the ejecting rod is sandwiched in between the dielectric housing and the shielding by passing through the cut of the shielding for ejecting the card.

* * * * *